US006315393B1

(12) United States Patent
Van Nice et al.

(10) Patent No.: US 6,315,393 B1
(45) Date of Patent: Nov. 13, 2001

(54) INK-JET PRINTHEAD

(75) Inventors: Harold Lee Van Nice; Salim Khasawinah; Neal W. Meyer, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/302,549

(22) Filed: Apr. 30, 1999

(51) Int. Cl.[7] ..... B41J 2/135
(52) U.S. Cl. ..... 347/45
(58) Field of Search ..... 347/45

(56) References Cited

U.S. PATENT DOCUMENTS

| | | | |
|---|---|---|---|
| 5,305,015 | 4/1994 | Schantz et al. . | |
| 5,516,500 | 5/1996 | Liu et al. . | |
| 5,554,415 | 9/1996 | Turchan et al. . | |
| 5,620,754 | 4/1997 | Turchan et al. . | |
| 5,635,243 | 6/1997 | Turchan et al. . | |
| 5,643,641 | 7/1997 | Turchan et al. . | |
| 5,648,127 | 7/1997 | Turchan et al. . | |
| 5,731,046 | 3/1998 | Mistry et al. . | |
| 6,071,597 * | 6/2000 | Yang et al. | 428/209 |

FOREIGN PATENT DOCUMENTS

WO 95/20253 7/1995 (WO) .

OTHER PUBLICATIONS

Incropera et al. "Fundamentals of Heat and Mass Transfer", Second Edition, pp. 37 & 178–179 & 282–283.
Srinivasan et al. "Self–Developing Photoetching of Poly-(ethylene terephthalate) Films by Farultraviolet Excimer Laser Radiation", Appl. Phys. Lett. vol. 41 No. 6 Sep. 15, 1982, pp. 576–577.
Rohsenow et al. "Handbook of Heat Transfer", pp. 26, 37, 48–49, 58, 86–88, 93, 97–98,103.

* cited by examiner

*Primary Examiner*—John Barlow
*Assistant Examiner*—Michael S. Brooke

(57) ABSTRACT

The invention contemplates a flexible film, and a printhead (TAB head assembly) comprising the same; the flexible film having a converted surface with improved resistance. The converted surface comprises a carbon rich layer, preferably, Diamond Like Carbon (DLC) created through simultaneous surface treatment by multiplexed lasers.

12 Claims, 2 Drawing Sheets

INK-JET PRINTHEAD

FIELD OF INVENTION

The present invention generally relates to printheads for ink-jet printers, and more particularly, to treatment and fabrication of printheads to produce desired composite material.

BACKGROUND OF INVENTION

Ink-jet printing is a non-impact printing process in which droplets of ink are deposited on a print medium in a particular order to form alphanumeric characters, area-fills, and other patterns thereon. An ink-jet image is formed when a precise pattern of dots is ejected from a drop-generating device, known as a "printhead", onto a printing medium. The typical inkjet printhead has an array of precisely formed nozzles in an orifice plate typically comprised of a planar substrate comprised of a polymer material and attached to a thermal ink-jet printhead substrate. The substrate incorporates an array of firing chambers that receive liquid ink (colorants dissolved or dispersed in a solvent) from a supply channel (or ink feed channel) leading from one or more ink reservoirs. Each chamber has a thin film resistor, known as a "firing resistor, " located opposite the nozzle. A barrier layer located between the substrate and the orifice forms the boundaries of the firing chamber and provides fluidic isolation from neighboring firing chambers. The printhead is mounted on and protected by an outer packaging referred to as a print cartridge.

The thin film substrate is typically comprised of a substrate such as silicon on which are formed various thin film layers that form thin film ink firing resistors, apparatus for enabling the resistors, and also interconnections to bonding pads that are provided for external electrical connections to the printhead. The thin film substrate more particularly includes a top thin film layer of tantalum disposed over the resistors as a thermomechanical passivation layer.

The ink barrier layer is typically a polymer material that is laminated as a dry film to the thin film substrate, and is designed to be photo-definable and both UV and thermally curable.

When the resistor is heated, a thin layer of ink above the resistor is vaporized to create a drive bubble. This forces an ink droplet out through the nozzle. After the droplet leaves and the bubble collapses, capillary force draws ink from the ink feed channel to refill the nozzle.

Typically, as the printhead scans across the print medium, the ink and other unwanted debris may accumulate on the orifice plate. To minimize the presence of this unwanted material, the printhead is wiped clean by a wiper material (typically on-board the printer) typically made of EPDM rubber. The wiping, among other things, may lead to a change in the surface morphology of the orifice plate around the nozzle due to creep and flow of the orifice plate material. This change, herein referred to as "ruffles, " in the orifice plate, may in turn lead to misdirected ink drops, hence print quality defects.

Thus, it would be advantageous to provide an improved ink-jet printhead with improved orifice plate to minimize unwanted print defects.

DISCLOSURE OF THE INVENTION

The invention contemplates a flexible film and a printhead (TAB head assembly) comprising the same; the flexible film having a converted surface with improved resistance. The converted surface comprises a carbon rich layer, preferably, Diamond Like Carbon (DLC) created through simultaneous surface treatment by multiplexed lasers.

DETAILED DESCRIPTION OF THE INVENTION

Figure 1:
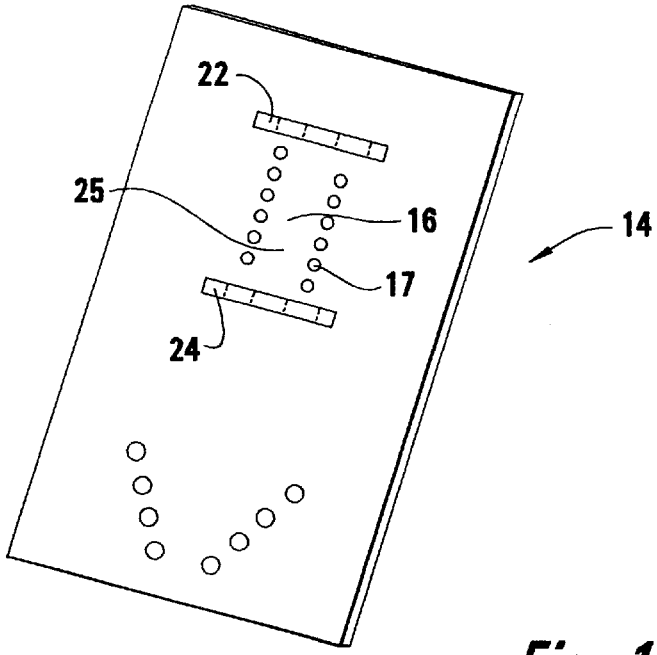
FIG. 1 is a perspective view of the front surface of the Tape Automated Bonding (TAB) printhead assembly (hereinafter called "TAB head assembly").

Referring to FIG. 1 set forth therein is an unscaled schematic perspective view of the front of an ink jet printhead 14 in which the invention can be employed, where the printhead 14 is formed using Tape Automated Bonding (TAB). The print head 14 (hereinafter "TAB head assembly 14") generally includes a thin film die 28 comprising a material such as silicon and having various thin film layers formed thereon; an ink barrier layer 30 disposed on the die 28; and an orifice or nozzle member 16 attached to the top of the ink barrier 30 and comprising two parallel columns of offset holes or orifices (nozzles) 17 formed in a flexible polymer substrate 18 by, for example, laser ablation. The polymer substrate 18 preferably is plastic such as teflon, polyimide, polymethylmethacrylate, polycarbonate, polyester, polyamide, polyethyleneterephthalate or mixtures and combinations thereof, having a front surface 25 having a converted or fabricated layer 210 with improved resistance thereon (see FIG. 3). The converted layer 210 comprises at least one carbon rich layer 204, and additionally, at least one other, preferably, two other layers, having different morphology than the carbon rich layer and the unconverted substrate. Examples of carbon rich layer include, diamond, diamond-like carbon coating (DLC), CBN, $B_4C$, SiC, TiC, $Cr_3C_2$, and cubic Carbon Nitride (cCN). The unconverted polymer substrate 103(substrate 18 without the converted layer 210) may be purchased commercially as Kapton™ in the form of a tape reel 105, available from DuPont Corporation. Other suitable tape may be formed of Upilex™ or its equivalent. The converted layer 210 preferably comprises, Diamond Like Carbon (DLC) and the substrate comprises polyimide (PI).

Figure 2:
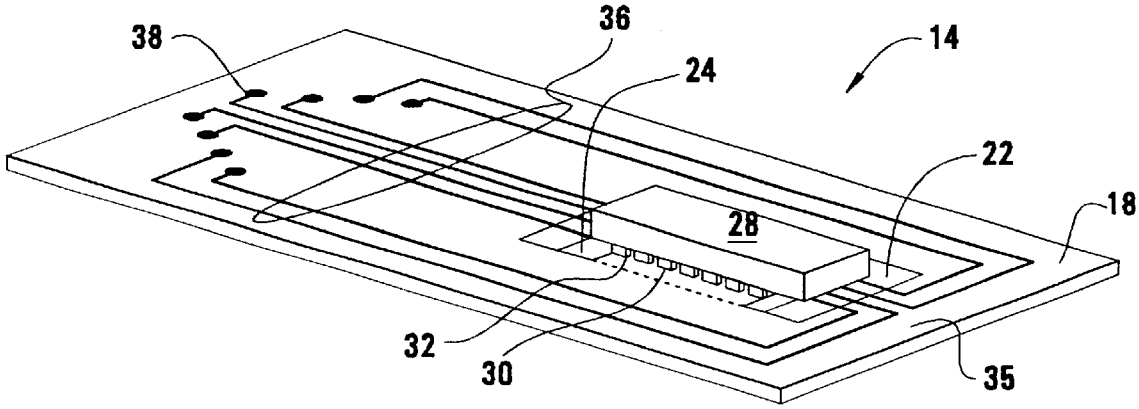
FIG. 2 is a perspective view of the back surface of the TAB head assembly of FIG. 1 with a silicon die mounted thereon and the conductive leads attached to the die.

FIG. 2 shows a back surface 35 of the TAB head assembly 14 of FIG. 1 showing the die 28 mounted to the back of the substrate 18 and also showing one edge of the barrier layer 30 formed on the die 28 containing ink channels 32. The back surface 35 of substrate 18 (opposite the surface which faces the recording medium and has the composite layer 210) includes conductive traces 36 (formed thereon using a conventional photolithographic etching and/or plating process. These conductive traces 36 are terminated by large contact pads 20 (FIG. 1) designed to interconnect with printer electrodes providing externally generated energization signals to the TAB head assembly 14. To access these traces from the front surface of the substrate 18, holes (vias)

must be formed through the front surface of the substrate 18 to expose the ends of the traces. The exposed ends of the traces are then plated with, for example, gold to form the contact pads 20 shown on the front surface of the substrate 18. Windows 22 and 24 extend through the tape 18 and are used to facilitate bonding of the other ends of the conductive traces to electrodes on the die 28 containing heater resistors.

Figure 3:
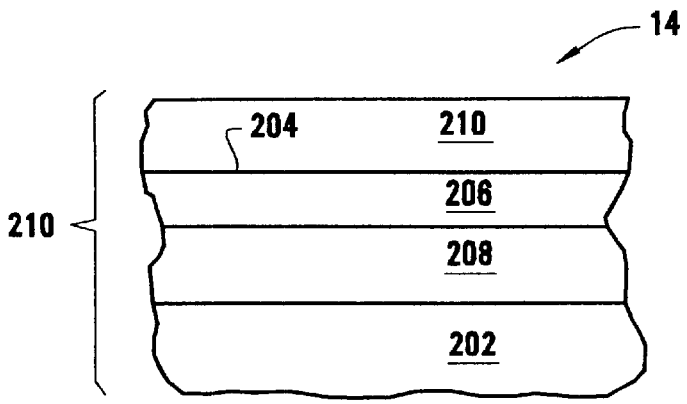
FIG. 3 is a side cross-sectional view of a tape treated comprising a converted layer 210.

FIG. 3, shows a cross section of converted substrate 18 comprising a converted layer 210. Therein is shown a polymer film 202 having a converted layer 210, comprising a top diamond rich surface layer 204, a second layer 206 formed below the surface layer 204, and a third layer 208 formed beneath the second layer 206.

To fabricate the surface of the unconverted substrate 103 to produce converted substrate 18, the substrate 103 can undergo fabrication process of the present invention before or after its construction into the TAB head assembly 14, as is known in the art. Therefore, when referring to the treatment of the an unconverted substrate (e.g., substrate 103), the term refers to either or both an unconverted tape before and after its adaptation to form the TAB head assembly 14, while the term converted substrate (e.g., substrate 18) refers to either or both a converted substrate before and after its adaptation to form the TAB head assembly 14.

Figure 4:
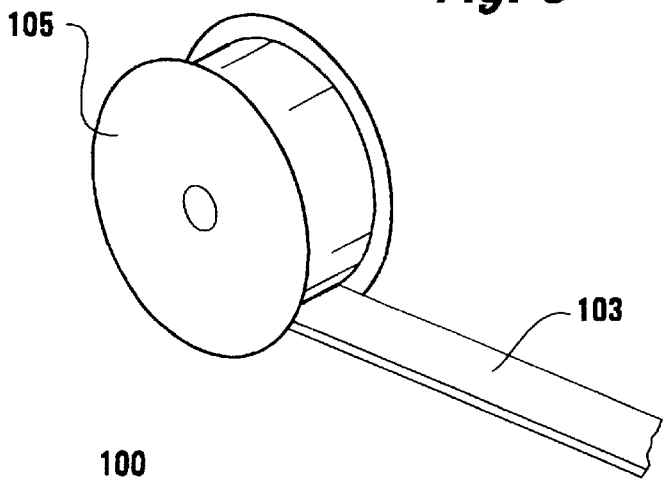
FIG. 4 is a perspective view of a tape available in long strips on a reel.

The substrate 103 is typically produced in long strips on a reel 105, as shown in FIG. 4. In the preferred embodiment, the substrate 103 is already provided with conductive copper traces 36, such as shown in FIG. 2, formed thereon using conventional photolithographic and metal deposition processes. The particular pattern of conductive traces depends on the manner in which it is desired to distribute electrical signals to the electrodes formed on silicon dies, which are subsequently mounted on the substrate 103.

To bring about the fabrication of the substrate 103 to generate substrate 18, the substrate 103 is subjected to simultaneous treatment by two or more laser sources.

Figure 5:
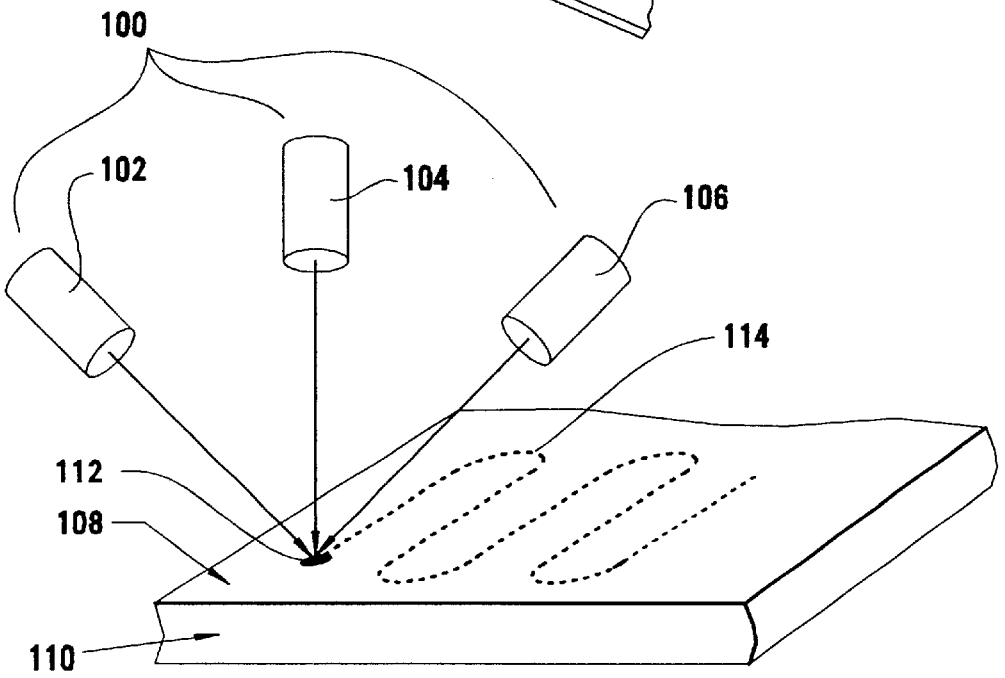
FIG. 5 is a perspective view showing three energy sources treating the surface of a tape producing the treated (converted) tape of FIG. 3.

FIG. 5 shows an embodiment of the invention wherein an energy source 100 comprising three lasers 102, 104 and 106 is used for treating the surface 108 of a substrate 110. The three lasers each output a beam onto a selected area 112 of the surface 108 of a substrate 110. The beams can be scanned, or the substrate 110 can be moved, so that the selected area is scanned in a path 114 across the surface 108 of the substrate 110. A first laser 102 is preferably an excimer laser operating in a range from about 200 to about 450 watts. Such excimer lasers are useful for causing electronic excitation of the polymer molecules by producing wavelengths such as 193, 248, 308 nm. A second laser 104 is used to supports the reaction by thermally heating the substrate. The laser 104 is preferably a Nd/YAG laser operating in a range from about 200 to about 800 watts. A third laser 106, preferably a $CO_2$ laser, is used to provide thermal balance, and operates in a range from about 20 to about 50 watts.

It should be noted that although the lasers are shown in FIG. 5 as directing their respective beams onto the reaction zone of the substrate 110 from different angles, it is within the scope of the present invention that the beams could be directed coaxially at the reaction zone. Furthermore, as indicated earlier, two or more sources may be used. For example, the $CO_2$ laser may be eliminated if necessary.

The substrate 103 (unconverted polymer) of the present invention comprises at least 25% elemental carbon, more preferably from about 25% to about 75% elemental carbon. The carbon rich layer 204 of the present invention typically has an $Sp^2$ to $Sp^3$ ratio in the range from about 1:1.5 to about 1:9, more preferably, from about 1:2.0 to about 1:2.4, and most preferably, from about 1:2.2 to about 1:2.3.

Terms such as DLC, diamond-like carbon, amorphous carbon, a-C, a-C:H, are used to designate a class of films which primarily consist of carbon and hydrogen. The structure of these films is considered amorphous; that is, the films exhibit no long-range atomic order, or equivalently, no structural correlation beyond 2–3 nanometers. The carbon bonding in these films is a mixture of $sp^2$ and $sp^3$, with usually a predominance of $sp^3$ bonds.

In the present invention, the presence of the layers was confirmed using scanning electron microscopy (SEM) in which at least three distinct layers, namely, 204, 206, and 208, were shown to be present on the surface of substrate 18. It was also determined that the conversion layer 210 corresponded to about 10% of the total thickness of the converted substrate 18. For example, for converted substrate 18 having a total thickness of about 50 microns, 4 microns (approximately 10%) comprised of conversion layer 210. The composition and make up of the surface of the first layer 204 was measured using X-ray photo electron spectroscopy (XPS), indicating that the surface composition (204) of the converted substrate 18 comprised about 97% carbon, 3% oxygen, and almost 0% nitrogen, from an initial composition for the unconverted substrate 103 of 65% carbon, 27% oxygen, and 8% nitrogen. It should be noted that the atomic percentages are normalized based on the three measured elements. Furthermore, evaluation by Raman spectroscopy confirmed the presence of DLC as indicated by the presence of mixture of $sp^2$ and $sp^3$ bonds with usually a predominance of $sp^3$ bonds, indicative of presence of DLC.

The converted substrate 18 provided for a TAB head assembly 14 (or just the substrate before utilization in making of the TAB head assembly) having a harder surface as also evidence by the change in the surface hardness values from about 0.45 GPa (giga pascal) before treatment to about 5 Gpa after the treatment.

Thus there has been disclosed an improved substrate 18 and TAB head assembly 14, wherein the resulting substrate 18 has an improved hardened surface 25, in particular, around the nozzles 17, thereby reducing mechanical damage to the surface of the thin film polymer. Furthermore, the substrate 18 of the present invention enables the removal or minimization of existing scratches or surface defects and reduced mechanical damage to features in the film such as recesses or nozzles.

What is claimed is:

1. An inkjet printhead comprising:

a flexible polymer substrate (18), a back surface (35) of the flexible polymer substrate mounted with a die (28), the die forming ink channels (35) on the back surface, the ink channels linked to offset holes (17) in the flexible polymer substrate, a front surface (25) of the flexible polymer substrate having a converted layer (210) thereon, wherein the converted layer (210) comprises a first carbon rich layer (204) and a second carbon rich layer (206) disposed between the first layer (204) and the back surface (35), wherein the second layer (206) has a morphology different than that of the first layer (204).

2. The inkjet printhead of claim 1 wherein the carbon rich layer (204) comprises at least one material selected from the group consisting of diamond, diamond-like carbon coating (DLC), CBN, $B_4C$, SiC, TiC, $Cr_3C_2$, and cubic Carbon Nitride (cCN).

3. The inkjet printhead of claim 1 wherein the substrate (18) comprises polymer film (202) selected from the group consisting of teflon, polyimide, polymethylmethacrylate, polycarbonate, polyester, polyamide, polyethyleneterephthalate, and mixtures and combinations thereof.

4. The inkjet printhead of claim 3 wherein the carbon rich layer (204) comprises diamond like carbon and the polymer film (202) comprises polyimide.

5. The inkjet printhead as in claims 3 or 4 wherein the front surface (25) has a hardness value greater than the polymer film (202).

6. The inkjet printhead of claim 1 further comprising a third layer (208) disposed between the second layer (206) and the back surface (35) of the flexible polymer substrate (18).

7. A TAB head assembly (14) comprising:

a substrate (18), a back surface (35) of the substrate mounted with a die (28), the die forming ink channels (35) on the back surface, the ink channels linked to offset holes (17) in the substrate, a front surface (25) of the substrate having a converted layer (210) thereon, wherein the converted layer (210) comprises a first carbon rich layer (204) and a second carbon rich layer (206) disposed between the first layer (204) and the back surface (35), wherein the second layer (206) has a morphology different than that of the first layer (204).

8. The TAB head assembly of claim 7 wherein the carbon rich layer (204) comprises at least one material selected from the group consisting of diamond, diamond-like carbon coating (DLC), CBN, $B_4C$, SiC, TiC, $Cr_3C_2$, and cubic Carbon Nitride (cCN).

9. The TAB head assembly (14) of claim 7 wherein the substrate (18) comprises polymer film 202 selected from the group consisting of teflon, polyimide, polymethylmethacrylate, polycarbonate, polyester, polyamide, polyethyleneterephthalate, and mixtures and combinations thereof.

10. The TAB head assembly (14) of claim 9 wherein the carbon rich layer (204) comprises diamond like carbon and the polymer film (202) comprises polyimide.

11. The TAB head assembly (14) as in claims 9 or 10 wherein the front surface (25) has a hardness value greater than the polymer film (202).

12. The TAB head assembly (14) of claim 7 further comprising a third layer (208) disposed between the second layer (206) and the back surface of the flexible polymer substrate (18).

* * * * *